US007307378B2

(12) United States Patent
Ueno et al.

(10) Patent No.: US 7,307,378 B2
(45) Date of Patent: Dec. 11, 2007

(54) IN-LINE TYPE ELECTRON GUN AND COLOR CATHODE RAY TUBE APPARATUS USING THE SAME

(75) Inventors: Hirofumi Ueno, Ibaraki (JP); Tsutomu Takekawa, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 288 days.

(21) Appl. No.: 11/046,399

(22) Filed: Jan. 28, 2005

(65) Prior Publication Data

US 2005/0174034 A1 Aug. 11, 2005

(30) Foreign Application Priority Data

Feb. 9, 2004 (JP) ..... 2004-032298

(51) Int. Cl.
*H01J 29/50* (2006.01)

(52) U.S. Cl. ..... 313/414; 313/446

(58) Field of Classification Search ..... 313/412–417
See application file for complete search history.

(56) References Cited

U.S. PATENT DOCUMENTS

| | | | | |
|---|---|---|---|---|
| 5,055,749 | A | 10/1991 | Chen et al. | |
| 6,329,747 | B1 * | 12/2001 | Noguchi et al. | 313/414 |
| 6,642,646 | B1 | 11/2003 | Kwon | |
| 6,720,726 | B1 | 4/2004 | Kimiya et al. | |
| 2002/0079819 | A1 | 6/2002 | Choi | |

FOREIGN PATENT DOCUMENTS

| | | |
|---|---|---|
| JP | 7-21935 | 1/1995 |
| JP | 2001-155656 | 6/2001 |
| JP | 3320103 | 6/2002 |

* cited by examiner

*Primary Examiner*—Joseph Williams
(74) *Attorney, Agent, or Firm*—Hamre, Schumann, Mueller & Larson, P.C.

(57) ABSTRACT

An in-line type electron gun using a field superimposing type main lens system is provided that can attain good focusing properties by decreasing the size of the electron beam spot on the entire surface of the phosphor screen without being formed to be mechanically large. A field superimposing type main lens is formed by disposing two tubular electrodes opposite to each other and disposing a plate-like field correction electrode on each of the tubular electrodes on the sides not opposite to each other. On each of the opposite sides of the two tubular electrodes, an opening is formed by an edge portion and a folded portion. The shape of the opening may be an elongated flat-sided oval shaped aperture (laterally elongated aperture) that is formed by straight lines and semicircles and has a major diameter in the horizontal direction and a minor diameter in the vertical direction. The in-line type electron gun is configured such that a relationship B<A is satisfied, where A represents a minor diameter of the opening in the tubular electrode to which a relatively low voltage is applied, and B represents a minor diameter of the opening in the tubular electrode to which a relatively high voltage is applied.

4 Claims, 10 Drawing Sheets

IN-LINE TYPE ELECTRON GUN AND COLOR CATHODE RAY TUBE APPARATUS USING THE SAME

BACKGROUND OF THE INVENTION

1. Field of the Invention

The present invention relates to in-line type electron guns and color cathode ray tube (CRT) apparatuses using the same. More particularly, the invention relates to a color cathode ray tube apparatus applied in television receivers, computer displays and the like, and an in-line type electron gun that is used for the color cathode ray tube apparatus and is capable of achieving a good image quality by decreasing the size of the electron beam spot at the periphery of the phosphor screen.

2. Description of the Related Art

FIG. 10 shows the basic configuration of a commonly used color cathode ray tube apparatus used for television receivers and the like. As shown in FIG. 10, a color cathode ray tube apparatus generally is provided with a valve 3 including a face panel 1 and a funnel 2 connected to the rear portion of the face panel 1, and an electron gun 20 housed in a neck portion 2*a* of the funnel 2. A phosphor screen 5 including three-color phosphor layers arranged in dots or stripes that emit R (red), G (green) and B (blue) light, respectively is formed on the inner surface of the face panel 1. In the valve 3, a shadow mask 6 for controlling positions of arrival of electron beams emitted from the electron gun 20 is disposed opposite to the phosphor screen 5. The shadow mask 6 is an electrode for screening the colors of three electron beams 8R, 8G and 8B corresponding respectively to the colors R (red), G (green) and B (blue) that are emitted from the electron gun 20, and has many electron beam passage apertures. In addition, a deflection yoke 7 for deflecting the electron beams 8R, 8G and 8B emitted from the electron gun 20 in the vertical and horizontal directions is mounted on an outer circumference of the funnel 2 on the neck portion 2*a* side.

In a color cathode ray tube apparatus having a configuration as described above, the three electron beams 8R, 8G and 8B emitted from the electron gun 20 are deflected in the vertical and horizontal directions by horizontal and vertical magnetic deflection fields generated by the deflection yoke 7, and a color image is displayed on the phosphor screen 5 by horizontally scanning the phosphor screen 5 with a high frequency, while vertically scanning it with a low frequency, via the electron beam passage apertures of the shadow mask 6.

Specific examples of the color cathode ray tube apparatus having a configuration as described above include an in-line type color cathode ray tube apparatus using, as the electron gun 20, an in-line type electron gun that emits, toward the phosphor layers of the phosphor screen 5, three electron beams arranged in a line and including a center beam and a pair of side beams that travel on the same horizontal plane, while using a deflection yoke 7 for generating non-uniform magnetic fields including a pincushion-shaped horizontal deflection magnetic field and a barrel-shaped vertical deflection magnetic field such that the three electron beams self-converge.

Various types of electron guns can be used as the electron gun for emitting the three electron beams arranged in a line, and one example is the type called BPF (bi-potential focus). In addition, various systems can be used as the system of forming the main lens of the electron gun 20, and one example is the system called a field superimposing type main lens system (e.g., see JP3320103,B).

FIG. 7 shows a BPF electron gun using a field superimposing type main lens. As shown in FIG. 7, the electron gun 20 includes: three cathodes K arranged in a line in the horizontal direction; three heaters (not shown) for heating the three cathodes K, respectively; 1st to 4th grids G1 to G4 that are integrated and disposed in this order from the cathodes K side to the phosphor screen 5 side (the right side in FIG. 7). Each of these grids G1 to G4 is provided with three electron beam passage apertures corresponding respectively to the three cathodes K arranged in a line, or with a commonly used electron beam passage aperture through which the three electron beams pass.

A portion in which the 3rd-2 grid G3-2 and the 4th grid G4 are opposite to each other forms a field superimposing type main lens. This configuration is shown in FIGS. 8A and 8B. FIG. 8A is a perspective view showing a portion of the 3rd-2 grid G3-2 shown in FIG. 7, as viewed from the 4th grid G4 side. FIG. 8B is a perspective view showing a portion of the 4th grid G4 shown in FIG. 7, as viewed from the 3rd-2 grid G3-2 side. As shown in FIGS. 7 and 8A and 8B, the field superimposing type main lens is formed by disposing two tubular electrodes 9 opposite to each other, and disposing a plate-like field correction electrode 10 on each of the tubular electrodes 9 on the sides not facing each other. Generally, each of the tubular electrodes 9 includes: a tubular side wall portion 11; an edge portion 12 that is formed by bending the end of the side wall portion 11 and is opposite to the other tubular electrode 9; and a folded portion 13 that is formed continuously with the edge portion 12 and in parallel with the side wall portion 11 inside the side wall portion 11. On each of the opposite sides of the two tubular electrodes 9, an opening is formed by the edge portion 12 and the folded portion 13. The most common shape of the opening formed on the opposite sides of the two tubular electrodes 9 is an elongated flat-sided oval shaped aperture formed by straight lines and semicircles, as shown in FIGS. 8A and 8B.

When the outer diameter of the neck portion 2*a* of the funnel 2 is approximately 29 mm and electrodes in each of which three electron beam passage apertures are formed are used to form the main lens, the effective diameter of the main lens generally is represented by the diameter of the electron beam passage apertures and is about 5.0 mm. However, by using the above-described field superimposing type main lens system, it is possible to realize an effective diameter of the main lens of about 8.0 mm.

In the electron gun 20, a voltage of about 170 V is applied to the cathodes K, and the 1st grid G1 is grounded. A voltage of about 600 V is applied to the 2nd grid G2, and a voltage of about 8 kV is applied to the 3rd-1 and the 3rd-2 grids G3-1 and G3-2. A high voltage of 30 kV is applied to the 4th grid G4. Then, the cathodes K and the 1st and the 2nd grids G1 and G2 constitute a three-electrode portion for generating electron beams and forming an object point with respect to. the main lens. The 2nd grid G2 and the 3rd-1 grid G3-1 form a pre-focus lens, and this pre-focus lens serves to pre-focus electron beams emitted from the three-electrode portion. The field superimposing type main lens formed by the 3rd-2 grid G3-2 and the 4th grid G4 focuses the pre-focused electron beams on the phosphor screen 5 eventually, forming an electron beam spot on the phosphor screen 5. When the electron beams are deflected to the periphery of the phosphor screen 5 by the deflection yoke 7, a predetermined dynamic voltage is applied to the 3rd-2 grid G3-2, in accordance with the deflection distance. The dynamic voltage applied to the 3rd-2 grid G3-2 is in a parabolic pattern in which the voltage is lowest when the positions of the electron beams are located at the center of phosphor screen 5 and highest when the electron beams are deflected to a corner portion of the phosphor screen 5. When the electron beams are deflected to a corner portion of the phosphor screen 5, the potential difference between the 3rd-2 grid G3-2 and the 4th grid G4 is smallest, so that the intensity (focusing effect) of the main lens is weakest. At the same time, the effect of a quadrupole lens formed by the 3rd-1 grid G3-1 and the 3rd-2 grid G3-2 is strongest. This quadrupole lens is an electric field lens having a focusing effect in the horizontal direction and a diverging effect in the vertical direction. With the above-described configuration, it is possible, by decreasing the intensity of the main lens, to compensate for a phenomenon in which the distance between the electron gun 20 and the phosphor screen 5 increases and the image point is moved farther. Furthermore, it is possible to obtain a quadrupole lens that corrects deflection aberration resulting from the pincushion-shaped horizontal deflection magnetic field and the barrel-shaped vertical deflection magnetic field of the deflection yoke 7.

In order to achieve a good image quality of a color cathode ray tube apparatus, it has been necessary to decrease the size of the electron beam spot on the phosphor screen, and to form the spot in a uniform shape as close as possible to a true circle on the entire screen. Due to the recent spread of the digital broadcasting using high density pixels, there has been an increasing demand for color cathode ray tube apparatuses for television receivers to have the properties of decreasing the size of the electron beam spot on the phosphor screen and forming the spot in a uniform shape as close as possible to a true circle on the entire screen.

On the other hand, in a color cathode ray tube apparatus incorporating an in-line type electron gun that emits three electron beams arranged in a line, the spot of electron beams arriving at the phosphor screen 5 is elongated laterally (horizontally) in the direction toward the periphery of the phosphor screen 5, as shown in FIG. 9. This phenomenon reduces the resolution of the color cathode ray tube apparatus, resulting in deterioration of the image quality. This phenomenon is due to the non-uniform magnetic fields of the deflection yoke 7 formed to converge the three electron beams arranged in a line on the phosphor screen 5, and becomes more pronounced in areas closer to the periphery of the phosphor screen 5. It also becomes pronounced with an increase in the electric current of the electron beams.

Recently, there has been a trend for increasing the angle of deflection of color cathode ray tube apparatuses for television receivers, as the size of their screens increases and their depth decreases. In addition, the non-uniformity of the deflection magnetic fields has become high, worsening the problem that the electron beam spot is elongated laterally (horizontally) at the periphery of the phosphor screen.

That is, it is apparent that decreasing the horizontal diameter of the electron beam spot at the periphery of the phosphor screen is an effective method for improving the image quality. The most effective method for this purpose is to increase the effective diameter of the main lens. In the case. where a field superimposing type main lens system as described above is used to increase the effective diameter of the main lens, it is common to form the electron gun to be mechanically large for attaining a further increase in the effective lens diameter. This results in the necessity of increasing the outer diameter of the neck portion of the funnel.

In this method, however, it is necessary to design a completely new electron gun, as well as designing a completely new deflection yoke, so that a tremendous amount of cost and time will be required. Furthermore, the power consumption of the deflection yoke increases with an increase in the outer diameter of the neck portion of the funnel, resulting in an increase in the power consumption of monitor sets, television receivers and the like. This presents a disadvantage to consumers and therefore is not preferable.

The present invention has been achieved in order to solve the above-described problems in the conventional art, and it is an object of the present invention to provide an in-line type electron gun using a field superimposing type main lens system that can attain good focusing properties by decreasing the size of the electron beam spot on the entire surface of the phosphor screen without being formed to be mechanically large, and a color cathode ray tube apparatus using the in-line type electron gun.

SUMMARY OF THE INVENTION

In order to achieve the above-described object, an in-line type electron gun according to the present invention includes: an electron beam generating portion for generating three electron beams arranged in a line and including a center beam and a pair of side beams that travel on a same horizontal plane; and a main lens for accelerating and focusing the three electron beams. The main lens is formed by disposing at least two electrodes facing one other, wherein a portion in which the at least two electrodes are facing to one other includes a pair of tubular electrodes having an opening through which the center beam and the pair of side beams pass. The opening has a shape of a horizontally elongated aperture having a major dimension in a horizontal direction and a minor dimension in a vertical direction, and wherein a relationship $B<A$ is satisfied, where A represents a minor dimension of the opening in the tubular electrode to which a relatively low voltage is applied, and B represents a minor dimension of the opening in the tubular electrode to which a relatively high voltage is applied.

In the above-described in-line type electron gun according to the present invention, it is preferable that a relationship $0.5<B/A<1.0$ is satisfied. In this case, it is preferable that a relationship $0.6<B/A<0.8$ is satisfied. Furthermore, in this case, it is preferable that a plate-like field correction electrode is disposed at a position set back from an opening end of the tubular electrode to which a relatively low voltage is applied that is opposite to the tubular electrode to which a relatively high voltage is applied, with the field correction electrode having passage apertures through which the center beam and the pair of side beams pass individually, and that a relationship $C/A<0.6$ is satisfied, where C represents a length from an opening end of the tubular electrode to which a relatively low voltage is applied that is opposite to the tubular electrode to which a relatively high voltage is applied, to a surface of the field correction electrode that is opposite to the tubular electrode to which a relatively high voltage is applied.

Furthermore, a color cathode ray tube apparatus according to the present invention includes: a valve including a face panel having a phosphor screen including phosphor layers of a plurality of colors on an inner surface thereof and a funnel connected to a rear portion of the face panel; an electron gun housed in a neck portion of the funnel; a shadow mask that has a plurality of electron beam passage apertures for passing an electron beam emitted from the electron gun and is disposed in a predetermined position in the valve with a predetermined interval kept from the phosphor screen; and a deflection yoke mounted at an outer circumference of the funnel on the neck portion side for deflecting an electron beam emitted from the electron gun in vertical and horizontal directions, wherein the above-described in-line type electron gun according to the present invention is used as the electron gun.

The present invention makes it possible to increase the effective horizontal diameter of the main lens and to decrease its effective vertical diameter, thus decreasing the size of the electron beam spot formed on the phosphor screen, in particular, the horizontal diameter of the electron beam spot at the periphery of the phosphor screen. Consequently, it is possible to achieve a high-density display, and to improve the visibility of a displayed image by improving the uniformity of the electron beam spot on the entire surface of the phosphor screen. That is, the present invention can provide a color cathode ray tube apparatus producing high image quality.

DESCRIPTION OF THE PREFERRED EMBODIMENTS

Hereinafter, the present invention will be described more specifically by way of an embodiment.

Figure 10:
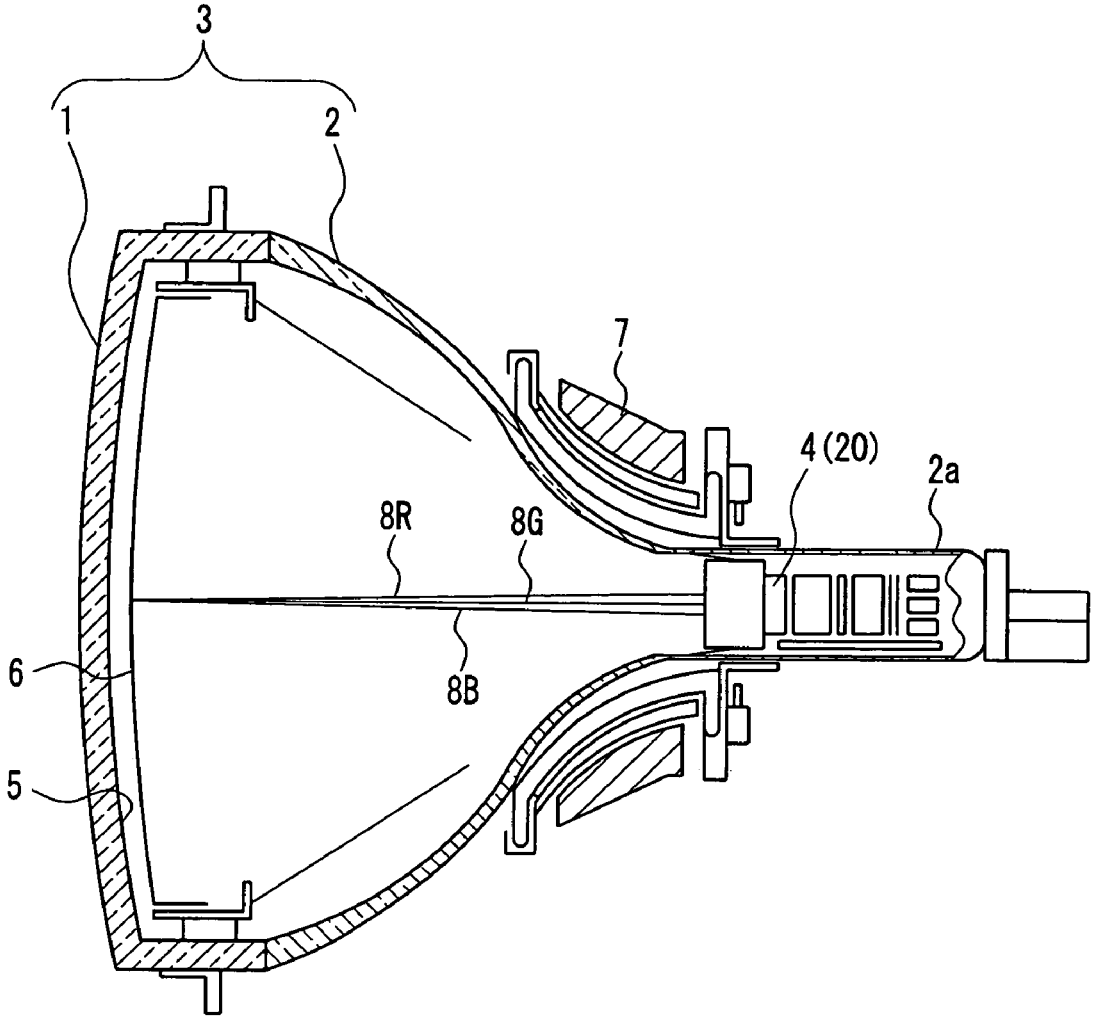
FIG. 10 PRIOR ART
FIG. 10 is a cross-sectional view showing a basic configuration of a commonly used color cathode ray tube apparatus.

The basic configuration of a color cathode ray tube apparatus according to this embodiment is similar to that of the commonly used color cathode ray tube apparatus shown in FIG. 10, so that this embodiment is described also with reference to FIG. 10.

As shown in FIG. 10, the color cathode ray tube apparatus according to this embodiment is provided with a valve 3 including a face panel 1 made of glass or the like and a funnel 2 that also is made of glass or the like and is connected to the rear portion of the face panel 1, and an electron gun 4 housed in a neck portion 2*a* of the funnel 2. A phosphor screen 5 including three-color phosphor layers arranged in dots or stripes that emit R (red), G (green) and B (blue) light, respectively, is formed on the inner surface of the face panel 1. A shadow mask 6 for controlling the positions of arrival of electron beams emitted from the electron gun 4 is disposed at a predetermined position in the valve 3 with a predetermined interval kept from the phosphor screen 5. The shadow mask 6 is an electrode for screening the colors of three electron beams 8R, 8G and 8B corresponding respectively to the colors R (red), G (green) and B (blue) emitted from the electron gun 4, and has many electron beam passage apertures. In addition, a deflection yoke 7 including a vertical deflection coil and a horizontal deflection coil is mounted at an outer circumference of the funnel 2 on its neck portion 2*a* side for deflecting the electron beams 8R, 8G and 8B emitted from the electron gun 4 in the vertical and horizontal directions. Here, the electron gun 4 is an in-line type electron gun that emits, toward the phosphor layers of the phosphor screen 5, three electron beams arranged in a line and including a center beam and a pair of side beams that travel on the same horizontal plane.

In a color cathode ray tube apparatus having a configuration as described above, the three electron beams 8R, 8G and 8B emitted from the electron gun 4 are deflected in the vertical and horizontal directions by horizontal and vertical deflection magnetic fields generated by the deflection yoke 7, and a color image is displayed on the phosphor screen 5 by horizontally scanning the phosphor screen 5 with a high frequency, while vertically scanning it with a low frequency, via the electron beam passage apertures of the shadow mask 6.

Figure 1A:
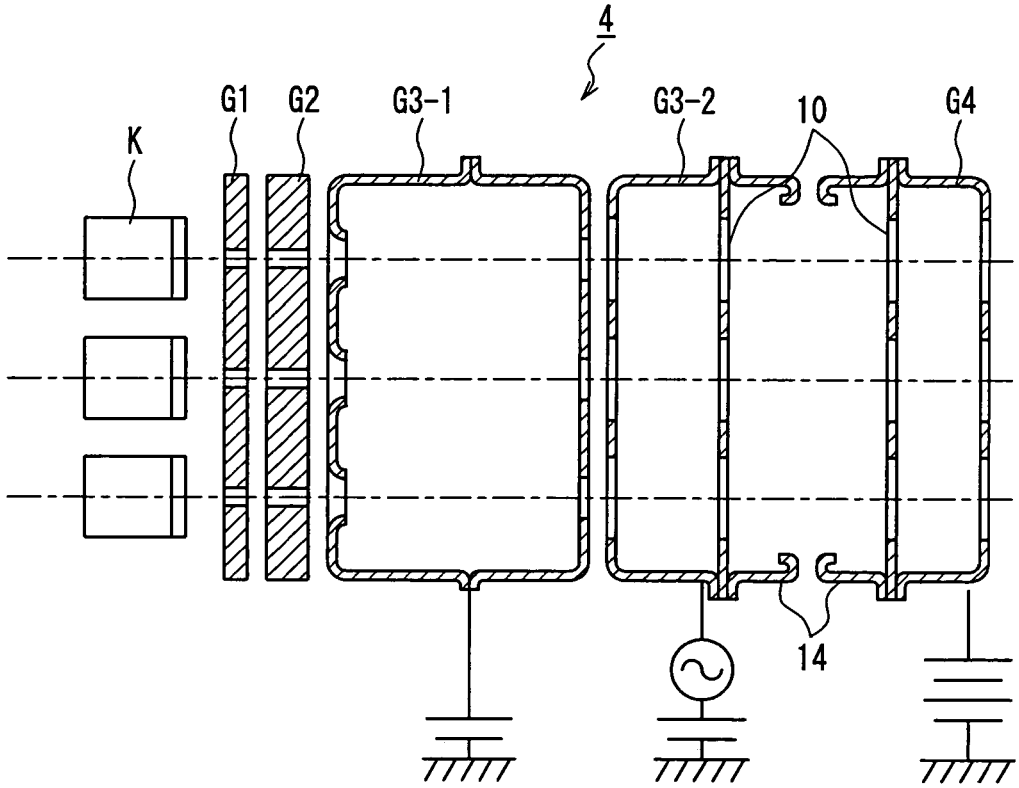
FIG. 1A is a horizontal cross-sectional view showing an in-line type electron gun according to an embodiment of the present invention.
Figure 1B:
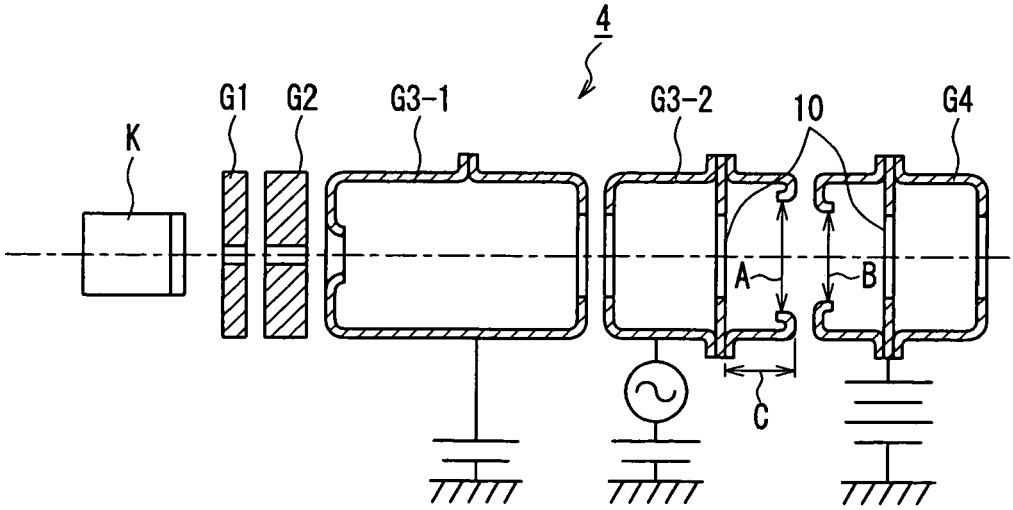
FIG. 1B is a vertical cross-sectional view thereof.

FIG. 1A shows a horizontal cross-sectional view of an in-line type electron gun according to this embodiment, and FIG. 1B shows a vertical cross-sectional view of the same in-line type electron gun. As shown in FIGS. 1A and 1B, the electron gun 4 of this embodiment includes: three cathodes K arranged in a line in the horizontal direction; three heaters (not shown) for heating the three cathodes K individually; 1st to 4th grids G1 to G4 that are integrated and disposed in this order from the cathodes K side to the phosphor screen 5 side (the right side in FIG. 1A), and these components are secured integrally to one another by a pair of insulating supports (not shown).

The 1st and the 2nd grids G1 and G2 are plate-like electrodes, on each of which three electron beam passage apertures corresponding respectively to the three cathodes K arranged in a line are formed. The 3rd-1 grid G3-1 is a box-like electrode, on each end of which three electron beam passage apertures corresponding respectively to the three cathodes K arranged in a line are formed. The 3rd-2 grid G3-2 includes: an electrode disposed on its surface facing the 3rd-1 grid G3-1 and having three electron beam passage apertures formed therein corresponding respectively to the three cathodes K arranged in a line; a plate-like field correction electrode 10 disposed on its side facing the 4th grid G4 and having three electron beam passage apertures formed therein corresponding respectively to the three cathodes K for forming a field superimposing type main lens; and a tubular electrode 14 having a common opening for three electron beams. The 4th grid G4 includes: an electrode disposed on its surface on the phosphor screen side and having three electron beam passage apertures formed therein corresponding respectively to. the three cathodes K arranged in a line; a tubular electrode 14 disposed on its side facing the 3rd-2 grid G3-2 and having a common opening for three electron beams formed for forming a field superimposing type main lens; and a plate-like field correction electrode 10 having three electron beam passage apertures formed therein corresponding respectively to the three cathodes K arranged in a line.

Figure 2B:
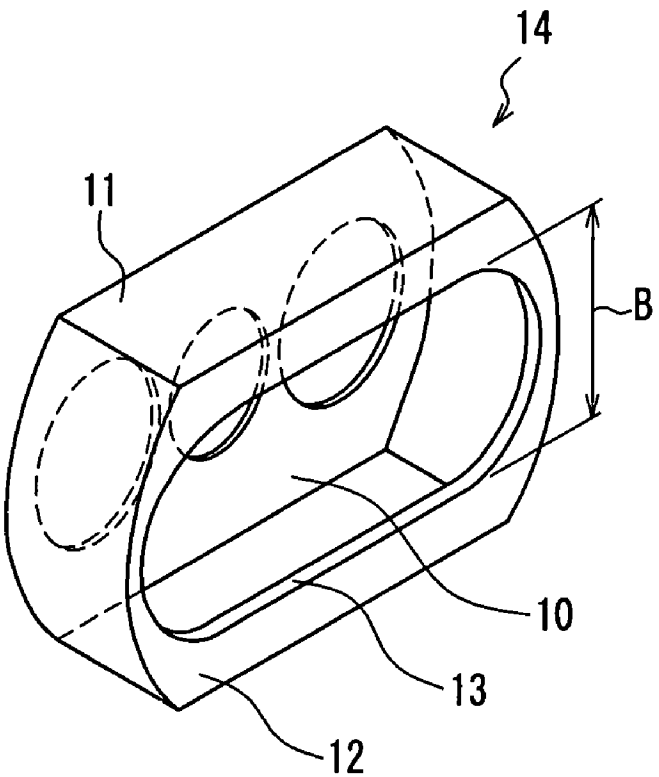
FIG. 2B is a perspective view showing a portion of the 4th grid shown in FIG. 1, as viewed from the 3rd-2 grid side, each showing a configuration of electrodes forming a field superimposing type main lens of an in-line type electron gun according to an embodiment of the present invention.
Figure 2A:
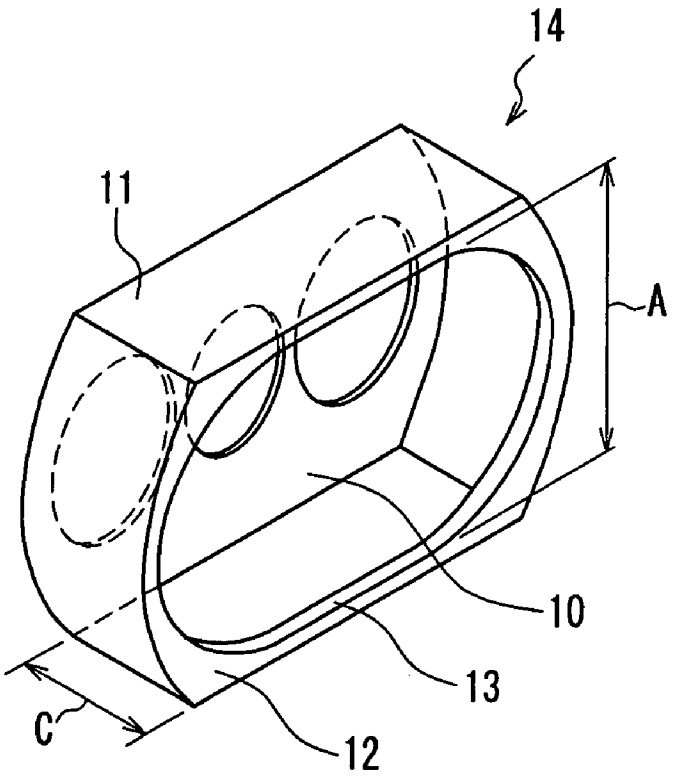
FIG. 2A is a perspective view showing a portion of the 3rd-2 grid shown in FIG. 1, as viewed from the 4th grid side.

FIG. 2A is a perspective view showing a portion of the 3rd-2 grid G3-2 shown in FIG. 1, as viewed from the 4th grid G4 side (an electrode to which a relatively low voltage is applied, as will be described later), and FIG. 2B is a perspective view showing a portion of the 4th grid G4 shown in FIG. 1, as viewed from the 3rd-2 grid G3-2 side (an electrode to which a relatively high voltage is applied, as will be described later), each showing a configuration of the electrodes forming the field superimposing type main lens. As shown in FIGS. 1A, 1B, 2A and 2B, the field superimposing type main lens is formed by disposing the two tubular electrodes 14 facing each other and disposing the plate-like field correction electrode 10 on each of the tubular electrodes 14 on the sides not facing each other. Each of the tubular electrodes 14 includes: a tubular side wall portion 11; an edge portion 12 that is formed by bending the end of the side wall portion 11 and is disposed facing the other tubular electrode 14; and a folded portion 13 that is formed continuously with the edge portion 12 and in parallel with the side wall portion 11 inside the side wall portion 11. On each of the opposite sides of the two tubular electrodes 14, an opening is formed by the edge portion 12 and the folded portion 13. Here, the opening has a shape that is larger in the horizontal direction and smaller in the vertical direction. That is, the shape of the opening is an elongated flat-sided oval shaped aperture (laterally elongated aperture) that is formed by straight lines and semicircles and has a major diameter in the horizontal direction and a minor diameter in the vertical direction.

In the electron gun 4, a voltage of about 170 V is applied to the cathodes K, and a voltage of about 0 V is applied to the 1st grid G1. A voltage of about 600 V is applied to the 2nd grid G2, and a constant voltage of about 8 kV is applied to the 3rd-1 grid G3-1. When the electron beams are deflected to the periphery of the phosphor screen 5 by the deflection yoke 7, a predetermined voltage is applied to the 3rd-2 grid G3-2, in accordance with the deflection distance. The voltage applied to the 3rd-2 grid G3-2 is in a parabolic pattern in which the voltage is lowest (about 8 kV) when the positions of the electron beams are located at the center of phosphor screen 5 and highest (8.8 kV) when the electron beams are deflected to a corner portion of the phosphor screen 5. A high voltage of about 30 kV is applied to the 4th grid G4. That is, when the electron beams are deflected to a corner portion of the phosphor screen 5, the potential difference between the 3rd-2 grid G3-2 and the 4th grid G4 is smallest, so that the intensity of the main lens is weakest.

The cathodes K and the 1st and the 2nd grids G1 and G2 constitute a three-electrode portion for generating electron beams and forming an object point with respect to the main lens. The 2nd grid G2 and the 3rd-1 grid G3-1 form a pre-focus lens, and this pre-focus lens serves to pre-focus electron beams emitted from the three-electrode portion. The field superimposing type main lens formed by the 3rd-2 grid G3-2 and the 4th grid G4 focuses the pre-focused electron beams on the phosphor screen 5 eventually, thus forming an electron beam spot on the phosphor screen 5.

Vertically elongated (longitudinally elongated) electron beam passage apertures for forming a quadrupole lens are formed in the 3rd-1 grid G3-1 on its 3rd-2 grid G3-2 side, and horizontally elongated (laterally elongated) electron beam passage apertures for forming a quadrupole lens are formed in the 3rd-2 grid G3-2 on its 3rd-1 grid G3-1 side. This quadrupole lens has a focusing effect in the horizontal direction and a diverging effect in the vertical direction. With the above-described configuration, it is possible, by decreasing the intensity of the main lens, to compensate for a phenomenon in which the distance between the electron gun 4 and the phosphor screen 5 increases and the image point is moved farther. Furthermore, it is possible to obtain a quadrupole lens that corrects deflection aberration resulting from the pincushion-shaped horizontal deflection magnetic field and the barrel-shaped vertical deflection magnetic field of the deflection yoke 7. In addition, the opening diameter B along the vertical central axis of the opening in the tubular electrode 14 (the higher voltage side) of the 4th grid G4 is set smaller than the opening diameter A along the vertical central axis of the opening in the tubular electrode 14 (on the lower voltage side) of the 3rd-2 grid G3-2. That is, the electron gun 4 according to this embodiment is configured such that $B<A$ is satisfied, where A represents a minor diameter of the opening in the tubular electrode 14 to which a relatively low voltage is applied, and B represents a minor diameter of the opening in the tubular electrode 14 to which a relatively high voltage is applied.

Figure 3:
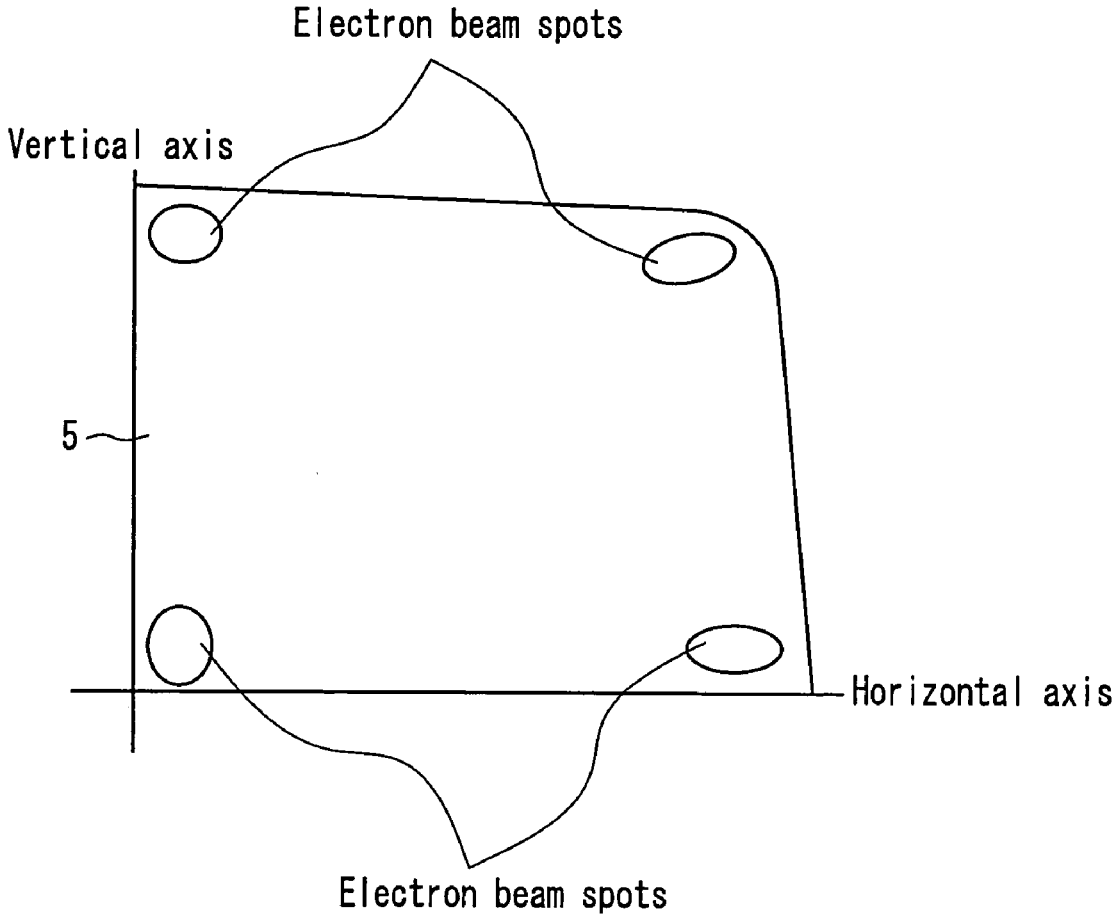
FIG. 3 is a diagram for illustrating the shape of an electron beam spot on a phosphor screen, in the case of using an in-line type electron gun according to an embodiment of the present invention.

Accordingly, the focusing lens portion formed on the lower voltage side of the main lens has a focusing effect that is weaker in the horizontal direction and stronger in the vertical direction. Conversely, the diverging lens portion formed on the higher voltage side of the main lens has a diverging effect that is weaker in the horizontal direction and stronger in the vertical direction. The main lens configured as described above has fewer aberrations in the horizontal direction and more aberrations in the vertical direction. As a result, it is possible to form a main lens whose effective horizontal diameter has been increased and whose effective vertical diameter has been decreased. As shown in FIG. 3, the use of such a main lens makes it possible to decrease the largest horizontal diameter of the electron beam spot at the periphery of the phosphor screen 5 among the electron beam spots obtained on the phosphor screen 5 (the effect of decreasing the horizontal diameter). On the other hand, this presents a phenomenon of increasing the vertical diameter of the electron beam spots obtained on the phosphor screen 5.

This phenomenon may present a minor problem because the electron beam spot will be elongated vertically (elongated longitudinally) at the center of the phosphor screen 5. However, this problem is not serious, since the electron beam spot is formed to be small at the center of the phosphor screen 5. On the other hand, increasing the vertical diameter of the electron beam spot at the periphery of the phosphor screen 5 brings the shape of the electron beam spot to be closer to a true circle through a synergistic effect with the above-described horizontal diameter decreasing effect, and therefore contributes to the formation of a good electron beam spot. When the entire phosphor screen 5 is evaluated comprehensively, it is possible to confirm that the uniformity of the shape of the electron beam spot has been improved for the entire phosphor screen 5 and the image quality has been enhanced.

Figure 4:
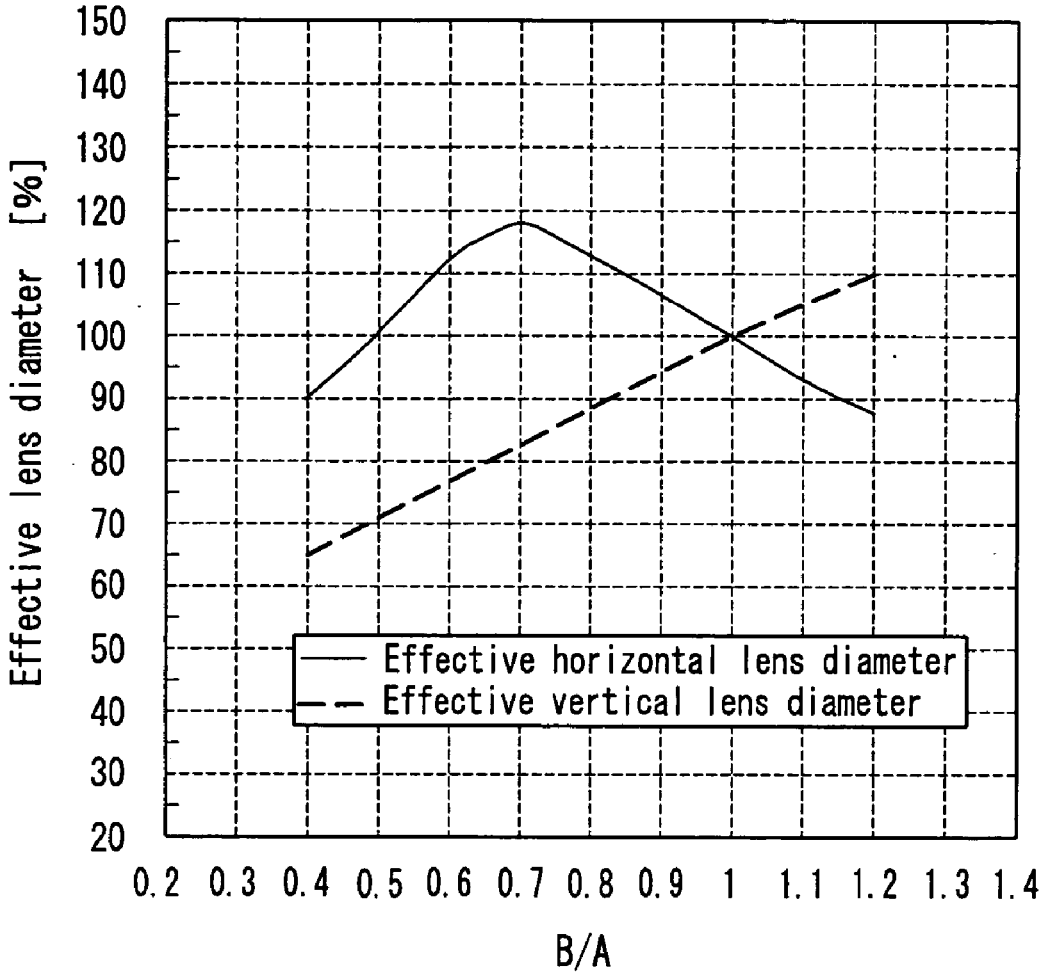
FIG. 4 is a graph showing the relationship between the effective diameter of a main lens and the value of B/A, where A represents a minor diameter of an opening of a tubular electrode to which a relatively low voltage is applied, and B represents a minor diameter of an opening of a tubular electrode to which a relatively high voltage is applied, in the case of using an in-line type electron gun according to an embodiment of the present invention.

FIG. 4 shows a result of determining the relationship between the value of B/A and the effective diameter of the main lens. In FIG. 4, the solid line indicates the relationship between the value of B/A and the effective horizontal lens diameter, and the broken line indicates the relationship between the value of B/A and the effective vertical lens diameter. From FIG. 4, it can be seen that, as the value of B/A is decreased, the effective horizontal lens diameter becomes larger and the effective vertical lens diameter becomes smaller, from the point where BA=1.0. However, as shown in FIG. 4, the effective horizontal lens diameter becomes smaller than its initial value when the value of B/A falls below 0.5, so that the horizontal diameter of the electron beam spot is increased. Therefore, the effect provided by increasing the effective horizontal diameter of the main lens can be exerted sufficiently by setting the value of B/A in the range of $0.5<B/A<1.0$.

The increase ratio of the effective diameter of the main lens and the decrease ratio of the electron beam spot on the phosphor screen are inversely proportional to each other within a practical range, and the horizontal diameter of the electron beam spot on the phosphor screen needs to be changed by about 5% in order to observe its decrease ratio visually. For this purpose, it is preferable to set the value of B/A in the range of $0.6<B/A<0.8$, as shown in FIG. 4. This makes it possible to enhance the effect of being capable of observing the decrease ratio of the horizontal diameter of the electron beam spot on the phosphor screen visually.

Furthermore, it also is possible to change the ratio of the effective horizontal diameter and the effective vertical diameter of the main lens by setting B<A and changing the length from the opening end of the tubular electrode 14 on the low voltage side (the 3rd-2 grid G3-2 side) that is facing the tubular electrode 14 on the higher voltage side (the 4th grid G4 side), to the surface of the field correction electrode 10 on the lower voltage side (the 3rd-2 grid G3-2 side) that is facing the tubular electrode 14 on the higher voltage side (the 4th grid G4 side), i.e., the length C in the tube axis direction of the tubular electrode 14 on the lower voltage side (the 3rd-2 grid G3-2 side).

Figure 5:
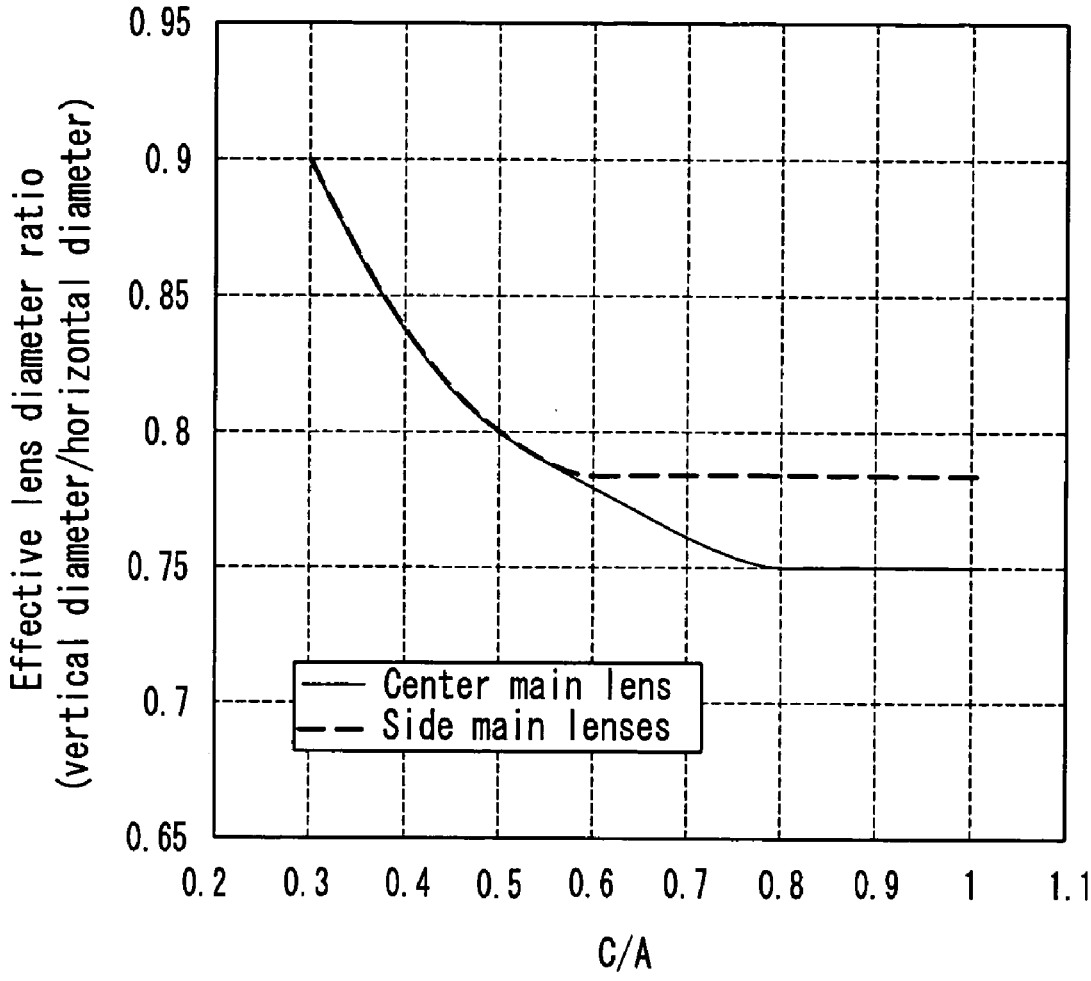
FIG. 5 is a graph showing the relationship between the effective diameter ratio (vertical diameter/horizontal diameter) of a main lens and the value of C/A, where A represents a minor diameter of an opening of a tubular electrode to which a relatively low voltage is applied, and C represents the length in the generatrix direction of a tubular electrode to which a relatively low voltage is applied, in the case of using an in-line type electron gun according to an embodiment of the present invention.

FIG. 5 shows a result of determining the relationship between the value of C/A and the effective diameter ratio (vertical diameter/horizontal diameter) of the main lens. In FIG. 5, the solid line indicates the relationship between the value of C/A and the effective diameter ratio of a center main lens, and the broken line indicates the relationship between the value of C/A and the effective diameter ratio of a pair of side main lenses. It should be noted that these relationships are results obtained when the value of B/A is 0.7. From FIG. 5, it can be seen that the values of the effective diameter ratio of the main lenses change with a change in the value of C/A. It also can be seen that, as the value of C/A is increased, the difference in characteristics between the center main lens and the pair of side main lenses through which in-line arranged three electron beams pass starts increasing from the point where C/A=about 0.6. Because of the characteristics of cathode ray tubes, the in-line arranged three electron beams preferably have the same spot shape, and the main lenses through which the respective electron beams pass need to have the same characteristics for this purpose. Therefore, it is preferable that a relationship $0.6<B/A<0.8$ and $C/A<0.6$ is satisfied, in order to increase the effective horizontal diameters of the main lenses and to decrease their effective vertical diameters, as well as matching the effective diameter of the center main lens and that of the pair of side man lenses to achieve a good image quality.

Additionally, a similar effect can be achieved even when the size of the electron gun is changed with a change in the outer diameter of the neck portion 2*a* of the funnel 2, since the absolute value of the effective diameter of the main lens changes, but the ratio of the effective horizontal lens diameter and the effective vertical lens diameter (vertical diameter/horizontal diameter) does not.

In the following, an example is shown for the specific dimensions of the electron gun of this embodiment used for a color cathode ray tube apparatus having an outer diameter of the neck portion 2*a* of the funnel 2 of 29 mm.

In the electron gun of this example, the length in the generatrix direction of the tubular electrode 14 of the 3rd-2 grid G3-2 (the lower voltage side) is C=4.5 mm, the opening diameter (the major diameter) along the horizontal central axis of the opening of the same tubular electrode 14 that faces the 4th grid G4 is 20.0 mm, and the opening diameter (the minor diameter) along the vertical central axis is A=9.0 mm. The opening diameter (the major diameter) along the horizontal central axis of the opening of the tubular electrode 14 of the 4th grid G4 (on the higher voltage side) is 20.0 mm, and the opening diameter (the minor diameter) along the vertical central axis is B=6.4 mm. As a result of setting the above-described dimensions, the value of B/A is 0.7, and the value of C/A is 0.5. Then, a main lens obtained with this configuration has an effective horizontal diameter of about 9.5 mm and an effective vertical diameter of about 6.5 mm.

Figure 9:
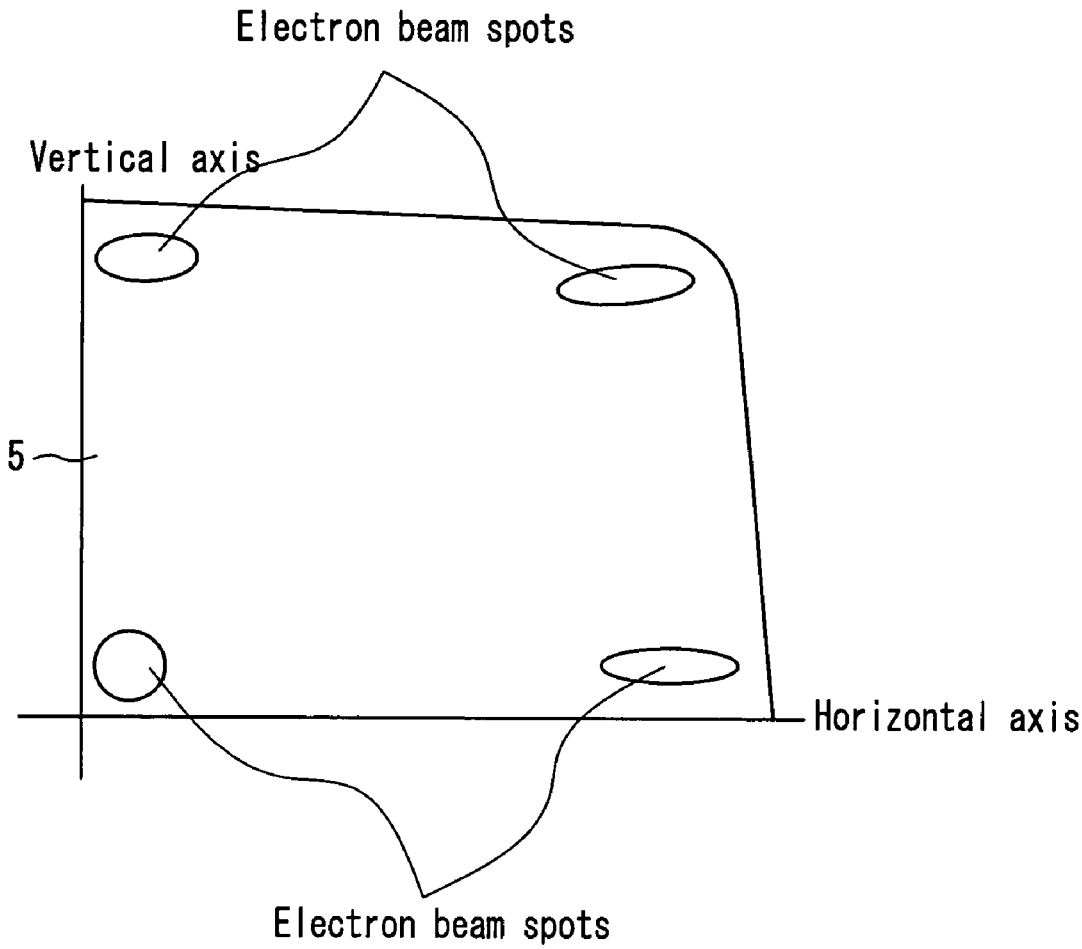
FIG. 9 PRIOR ART
FIG. 9 is a diagram for illustrating the shape of an electron beam spot on a phosphor screen, in the case of using a conventional in-line type electron gun.

In an electron gun having a configuration as described above, electron beams generated by a three-electrode portion constituted by the cathodes K and the 1st and the 2nd grids G1 and G2 are pre-focused by a pre-focus lens formed by the 2nd grid G2 and the 3rd-1 grid G3-1, and then pass through a quadrupole lens formed by the 3rd-1 grid G3-1 and the 3rd-2 grid G3-2. The electron beams that have passed through the quadrupole lens are subjected to a quadrupole effect at the quadrupole lens for compensating for a quadrupole effect exerted from the deflection magnetic fields of the deflection yoke 7, and enter the main lens of this embodiment whose effective horizontal diameter has been increased and whose effective vertical diameter has been decreased. Then, the electron beams that have passed through the main lens arrive at the phosphor screen 5, and form an electron beam spot. This electron beam spot is decreased in the horizontal direction and increased in the vertical direction, as compared with the case where the conventional electron gun is used (see FIG. 9), and slightly is elongated vertically (elongated longitudinally) at the center of the phosphor screen 5 and slightly is elongated horizontally (elongated laterally) at the periphery of the phosphor screen 5. Consequently, it is possible to achieve a highly uniform spot shape on the entire surface of the phosphor screen 5, thus improving the image quality.

Although an electron gun in which the 3rd grid G3 is divided so as to form a quadrupole lens is described as an example in this embodiment, an electron gun in which no quadrupole lens is formed and to which no dynamic voltage synchronized with the deflection magnetic fields of the deflection yoke 7 is applied also can exhibit an effect similar to that described above, by applying the present invention.

Although a color cathode ray tube apparatus having an outer diameter of the neck portion 2*a* of the funnel 2 of 29 mm is described in this embodiment, the present invention is useful particularly in a color cathode ray tube apparatus having an outer diameter of the neck portion of the funnel equal to or less than 32 mm.

Although the shape of the opening on the opposite sides of the two tubular electrodes 14 forming the field superimposing type main lens is described as being a flat-sided oval shape, horizontally elongated aperture formed by straight lines and semicircles in this embodiment, the shape of the opening is not necessarily limited to this shape, and may be any horizontally elongated aperture. Furthermore, although each of the openings is formed by the edge portion 12 and the folded portion 13 that are disposed on each of the opposite sides of the two tubular electrodes 14, the edge portion 12 and the folded portion 13 are not essential components of the present invention.

Figure 6B:
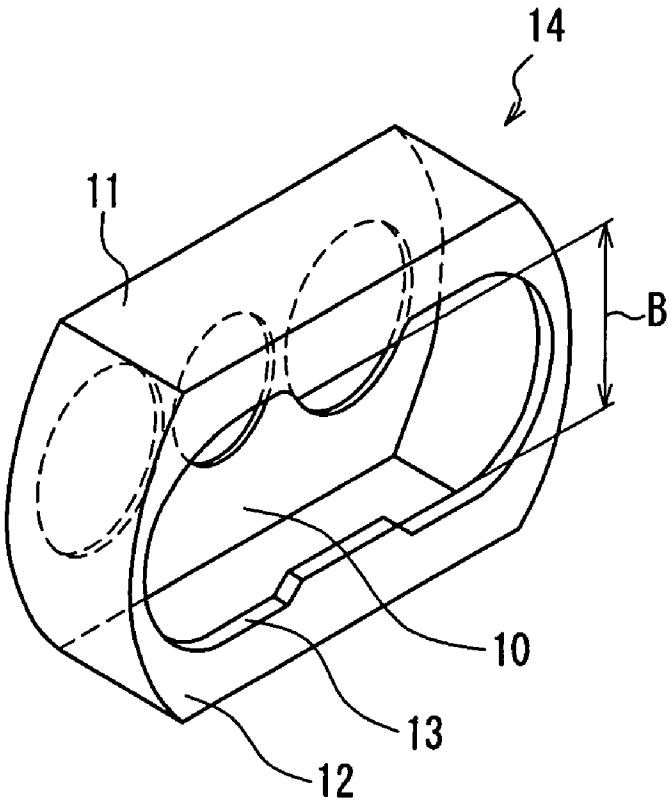
FIG. 6B is a perspective view showing a portion of the 4th grid shown in FIG. 1, as viewed from the 3rd-2 grid side, each showing another configuration of electrodes forming a field superimposing type main lens of an in-line type electron gun according to an embodiment of the present invention.
Figure 6A:
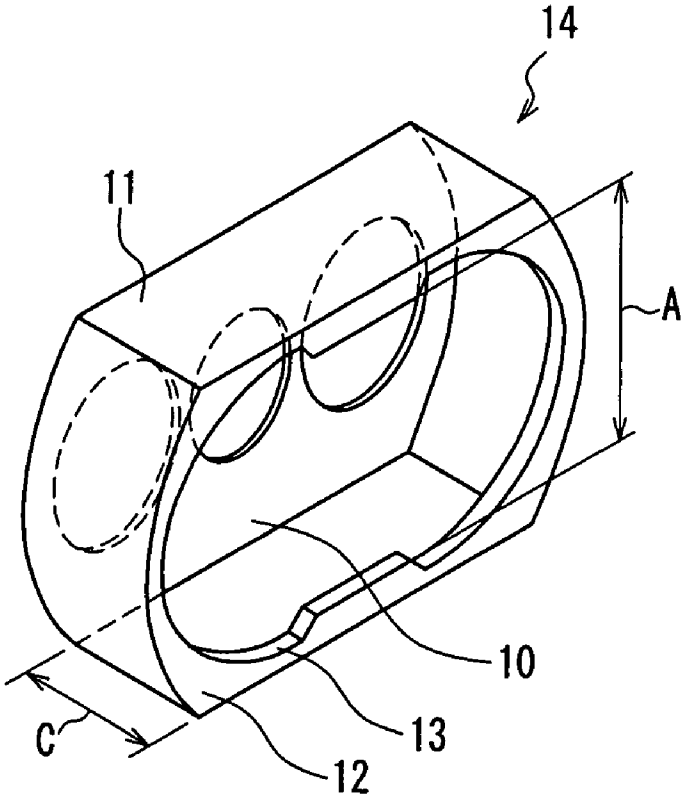
FIG. 6A is a perspective view showing a portion of the 3rd-2 grid shown in FIG. 1, as viewed from the 4th grid side.
Figure 7:
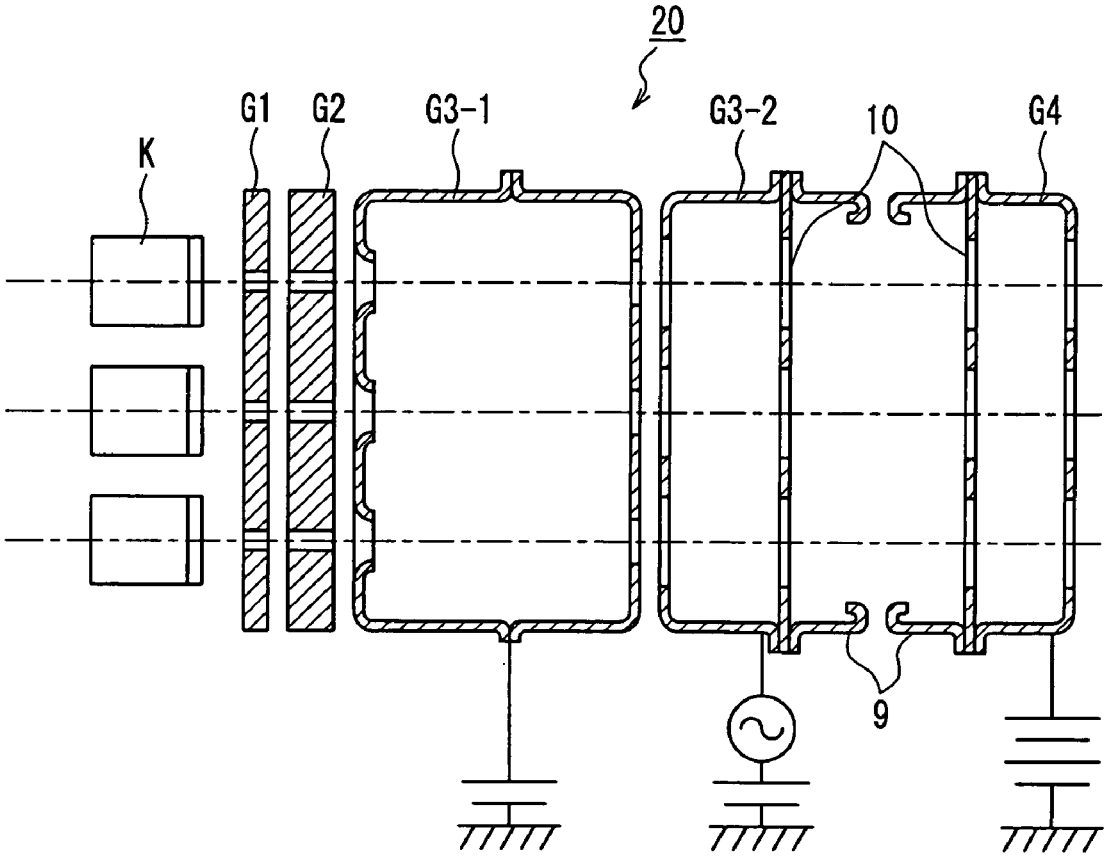
FIG. 7 PRIOR ART
FIG. 7 is a horizontal cross-sectional view showing a conventional BPF in-line type electron gun using a field superimposing type main lens.
Figure 8B:
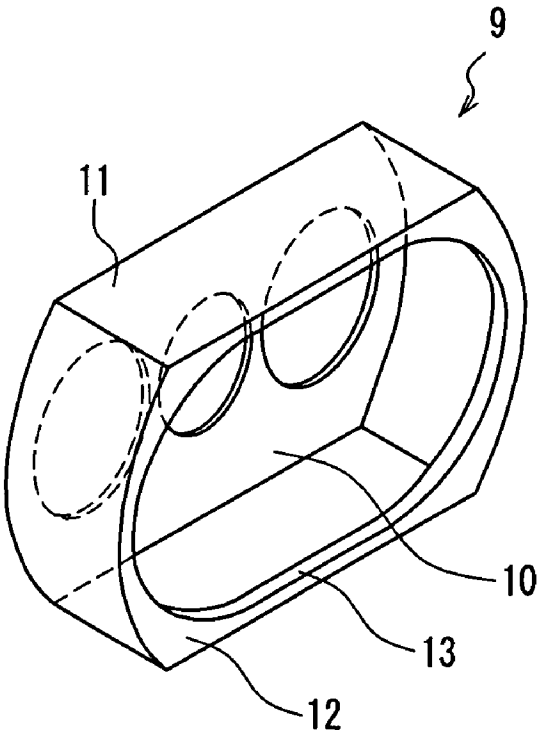
FIG. 8B PRIOR ART
FIG. 8B is a perspective view showing a portion of the 4th grid shown in FIG. 7, as viewed from the 3rd-2 grid side, each showing a configuration of electrodes forming a field superimposing type main lens of a conventional in-line type electron gun.
Figure 8A:
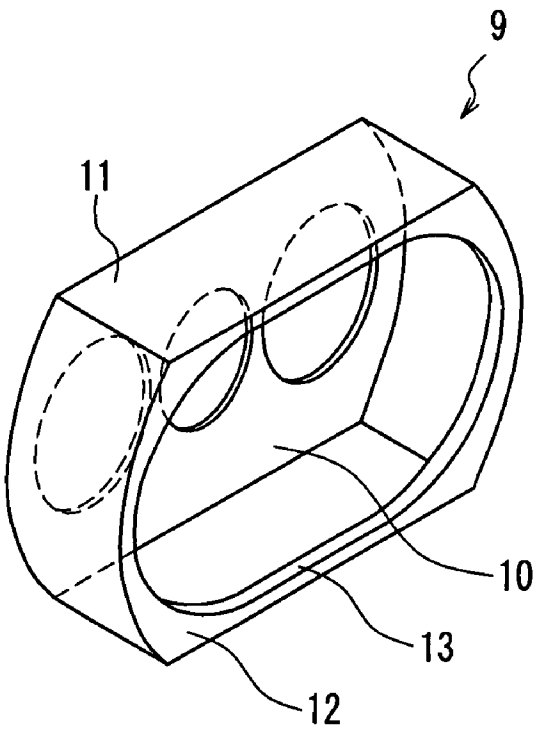
FIG. 8A PRIOR ART
FIG. 8A is a perspective view showing a portion of the 3rd-2 grid shown in FIG. 7, as viewed from the 4th grid side.

FIG. 6A is a perspective view showing a portion of the 3rd-2 grid G3-2 shown in FIG. 1, as viewed from the 4th grid G4 side (an electrode to which a relatively low voltage is applied), and FIG. 6B is a perspective view showing a portion of the 4th grid G4 shown in FIG. 1, as viewed from the 3rd-2 grid G3-2 side (an electrode to which a relatively high voltage is applied), each showing another configuration of electrodes forming a field superimposing type main lens. As shown in FIGS. 6A and 6B, the openings formed on the opposite sides of the two tubular electrodes 14 have the shape of a dumbbell, which has a vertically narrow portion. In a main lens having openings with such a shape, an effect similar to that described above also can be achieved by setting the opening diameter B along the vertical central axis of the opening in the tubular electrode 14 of the 4th grid G4 (on the higher voltage side) smaller than the opening diameter A along the vertical central axis of the opening in the tubular electrode 14 of the 3rd-2 grid G3-2 (on the lower voltage side).

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. An in-line type electron gun comprising:

an electron beam generating portion for generating three electron beams arranged in a line and comprising a center beam and a pair of side beams that travel on a same horizontal plane; and a main lens for accelerating and focusing the three electron beams, wherein the main lens is formed by disposing at least two electrodes facing one another, wherein a portion in which the at least two electrodes are facing to one another comprise a pair of tubular electrodes having an opening through which the center beam and the pair of side beams pass, wherein the opening has a shape of a horizontally elongated aperture having a major dimension in a horizontal direction and a minor dimension in a vertical direction, and wherein a relationship $0.5<B/A<1.0$ is satisfied, where A represents a minor dimension of the opening in the tubular electrode to which a relatively low voltage is applied, and B represents a minor dimension of the opening in the tubular electrode to which a relatively high voltage is applied.

2. The in-line type electron gun according to claim 1, wherein a relationship $0.6<B/A<0.8$ is satisfied.

3. The in-line type electron gun according to claim 2, further comprising a plate-like field correction electrode disposed at a position set back from an opening end of the tubular electrode to which a relatively low voltage is applied that is facing the tubular electrode to which a relatively high voltage is applied, the field correction electrode having passage apertures through which the center beam and the pair of side beams pass individually, wherein a relationship $C/A<0.6$ is satisfied, where C represents a length from an opening end of the tubular electrode to which a relatively low voltage is applied that is facing the tubular electrode to which a relatively high voltage is applied, to a surface of the field correction electrode that is facing the tubular electrode to which a relatively high voltage is applied.

4. A color cathode ray tube apparatus comprising:

a valve comprising a face panel having a phosphor screen including phosphor layers of a plurality of colors on an inner surface thereof and a funnel connected to a rear portion of the face panel;

an electron gun housed in a neck portion of the funnel;

a shadow mask that has a plurality of electron beam passage apertures for passing an electron beam emitted from the electron gun and is disposed in a predetermined position in the valve with a predetermined interval kept from the phosphor screen; and a deflection yoke mounted at an outer circumference of the funnel on the neck portion side for deflecting an electron beam emitted from the electron gun in vertical and horizontal directions, wherein the in-line type electron gun according to claim 1 is used as the electron gun.

* * * * *